US007585183B2

(12) United States Patent
Shimazu et al.

(10) Patent No.: US 7,585,183 B2
(45) Date of Patent: Sep. 8, 2009

(54) SWITCH WITH A PLURALITY OF CONTACT MODULES

(75) Inventors: Kenji Shimazu, Moriyama (JP); Shunkichi Sasaki, Osaka (JP); Hidemitsu Takenaka, Otsu (JP); Tetsuya Fukumoto, Kusatsu (JP)

(73) Assignee: OMRON Corporation, Kyoto (JP)

( * ) Notice: Subject to any disclaimer, the term of this patent is extended or adjusted under 35 U.S.C. 154(b) by 90 days.

(21) Appl. No.: 11/891,425

(22) Filed: Aug. 10, 2007

(65) Prior Publication Data

US 2008/0053809 A1 Mar. 6, 2008

(30) Foreign Application Priority Data

Sep. 6, 2006 (JP) ..... 2006-241239

(51) Int. Cl.
*H01H 13/14* (2006.01)

(52) U.S. Cl. ..... 439/530

(58) Field of Classification Search ..... 200/530, 200/337, 536, 254, 282, 339, 557, 61.29
See application file for complete search history.

(56) References Cited

U.S. PATENT DOCUMENTS

| | | | | |
|---|---|---|---|---|
| 3,118,026 A | | 1/1964 | Pusch et al. | |
| 3,270,154 A | * | 8/1966 | Stratton | 200/61.29 |
| 4,355,216 A | | 10/1982 | Kane et al. | |
| 4,433,222 A | * | 2/1984 | Kodaira | 200/536 |
| 4,883,932 A | * | 11/1989 | Van Hout et al. | 200/339 |
| 2004/0238339 A1 | | 12/2004 | Schwarz | |

FOREIGN PATENT DOCUMENTS

| | | |
|---|---|---|
| EP | 0702384 | 3/1996 |
| GB | 1488761 | 10/1977 |
| JP | 2000003636 | 1/2000 |
| JP | 2003-045294 | 2/2003 |
| JP | 2001210184 | 8/2003 |
| KR | 1020050121790 | 12/2005 |

OTHER PUBLICATIONS

European patent application No. 07115798.6-2214, European Search Report dated Jan. 14, 2008.
European patent application No. 07115798.6, Search Report dated May 6, 2008.

* cited by examiner

*Primary Examiner*—Edwin A. Leon
(74) *Attorney, Agent, or Firm*—Weaver Austin Villenueve & Sampson LLP

(57) ABSTRACT

Switches for a variety of circuits for different purposes are formed by using a plurality of similarly designed contact modules each having a module case incorporating a normally closed or normally open contact mechanism and a plunger for operating this contact mechanism, a single actuator having two end parts and being biased so as to rotate around a supporting axis between these contact modules, this actuator undergoing a rotary motion if a force is applied to one of its end parts so as to operate the plunger of an associated one of the contact modules with at least one of the end parts, a switch case that contains the contact modules and the actuator, and a push button for applying a force on one of the end parts of the actuator from outside the switch case.

6 Claims, 7 Drawing Sheets

SWITCH WITH A PLURALITY OF CONTACT MODULES

This application claims priority on Japanese Patent Application 2006-241239 filed Sep. 6, 2006.

BACKGROUND OF THE INVENTION

This invention relates to a switch with a plurality of contact modules.

As an example of a switch for opening and closing a plurality of circuits, Japanese Patent Publication Tokkai 2003-45294 describes a switch case incorporating a switching mechanism having a mobile plunger biased by a spring and provided with a plurality of mobile pieces corresponding to a plurality of fixed terminals such that the contacts for a plurality of circuits can be opened and closed as the plunger is moved.

With this kind of switch, however, the specification of the switching mechanism must be altered according to the number of the circuits, opening and closing characteristics (such as normally open or normally closed) and the purpose of use, and this means that products according to many different specifications must be prepared in order to respond to the needs and hence that the production cost becomes high because many kinds of expensive molds are needed for producing their components.

SUMMARY OF THE INVENTION

It is therefore an object of this invention in view of this problem to provide a switch that can be inexpensively produced in response to various needs.

Switches according to this invention are characterized as forming contact modules incorporating either generally open or closed contact mechanisms in a module case and providing contact modules with the same type of contact mechanisms and a single actuator for undergoing a seesaw-like rotary motion to a switch case such that the end parts of the actuator operate the contact modules.

According to this invention, a switch provided with contacts of at least either of normally open and normally closed kinds can be structured by incorporating in a switch case contact modules and an actuator which have been prepared preliminarily. Since the contact module corresponding to one of the end parts of the actuator which is caused to undergo a seesaw-like rotary motion becomes a normally open contact and the contact module corresponding to the other end part becomes a normally closed contact, a switch with any specified numbers of normally open and closed contacts can be obtained.

A plurality of such contact modules may be arranged along the supporting axis of the actuator according to a preferred embodiment of the invention. As an example of this preferred embodiment, three contact modules may be arranged in the direction of the supporting axis of the actuator, two of the contact modules being placed corresponding to one of the two end parts of the actuator and the remaining one contact module being placed corresponding to the other end part of the actuator such that a switch with two generally open contact points and one generally closed contact point may be obtained.

According to this preferred embodiment of the invention, a plurality of contact modules may be arranged in a same orientation along the supporting axis so as to have the operating parts of their plungers at different positions on both sides of the supporting axis. For such an embodiment, contact modules of two different kinds having operating parts at different positions may be preliminarily prepared such that specified numbers of them are arranged all in a same orientation along the supporting axis of the actuator.

Alternatively, a plurality of such contact modules may be arranged so as to have operating parts of the plungers at positions displaced from center of the module case on both sides of the supporting axis, specified ones of the contact modules being arranged in a reversed orientation along the supporting axis. According to this embodiment, each of the operating parts of a plurality of contact modules can be distributed to both sides of the supporting axis of the actuator merely by arranging a specified number of contact modules in a reversed orientation in the direction of the supporting axis of the actuator.

In the above, it is preferable to form each of the contact modules so as to incorporate a normally closed contact mechanism. If the contact modules were formed to incorporate a normally open contact mechanism, the mobile piece would be biased so as to separate from the pair of fixed terminals and to be connected to them by moving the plunger against the biasing force of the spring. In such a case, the mobile piece would be supported so as to be able to be elastically retracted such that the stroke of the plunger can be absorbed after the mobile piece contacts the fixed terminals. If the contact modules are formed to incorporate a normally closed contact mechanism, on the other hand, the mobile piece is normally in contact with the pair of fixed terminals, being fastened to the plunger and adapted to be separated from the fixed terminals as the plunger is pressed by means of a spring. Thus, the mobile piece would have to be provided to the plunger so as to be displaceable with respect thereto and a back-up spring would be necessary for biasing in the case of a generally open mechanism but the mobile piece may be fastened to the plunger in the case of a generally closed mechanism. Thus, the number of components can be reduced and the production cost can be lowered in the latter case.

Contact modules of this invention may be each characterized not only as comprising a generally open or generally closed contact mechanism having a pair of fixed terminals with fixed contact points and a mobile piece with a pair of mobile contact points corresponding to these fixed terminals, a plunger having an operating part for moving the mobile piece and a module case incorporating the contact mechanism and the plunger but also wherein the operating part of the plunger is eccentrically positioned with respect to the module case.

Two groups of such contact modules may be formed by arranging specified numbers of normally oriented contact modules and oppositely oriented contact modules such that their contact parts of their plungers are separated by a specified distance. If actuators rotatably supported around an axis is provided such that these two groups of contact parts can be operated by the end parts of this rotatably supported actuator, it is possible to obtain a switch for a plurality of circuits by using the contact modules of one of the groups as normally open contacts and those of the other group as normally closed contacts.

In order to easily (economically) form a switch as described above, this invention also relates to a pair of similarly designed contact modules each comprising a generally open or generally closed contact mechanism having a pair of fixed terminals with fixed contact points and a mobile piece with a pair of mobile contact points corresponding to these fixed terminals, a plunger having an operating part for moving the mobile piece and a module case incorporating the contact mechanism and said plunger wherein the operating part is positioned differently with respect to the module case between the pair.

In other words, switches for a variety of different circuits can be formed according to this invention by using contact modules of only two kinds that are nearly identically designed except that the position of the operating part of the plunger with respect to the module case is different between the two kinds of the contact modules.

As another example, this invention further relates to a pair of similarly designed contact modules each comprising a generally open or generally closed contact mechanism having a pair of fixed terminals with fixed contact points and a mobile piece with a pair of mobile contact points corresponding to the fixed terminals, a plunger having an operating part for moving the mobile piece, and a module case incorporating the contact mechanism and the plunger wherein the plungers of the pair have the same specifications and the operating parts of the pair are at shifted positions and mutually oppositely oriented with respect to the corresponding module case.

By this example, too, switches for a variety of different circuits can be formed according to this invention by using contact modules of only two kinds that are nearly identically designed except that the operating parts of the plungers of the pair are eccentrically positioned and mutually oppositely oriented with respect to the corresponding module case.

In summary, switches for a variety of circuits for different purposes can be easily and economically formed by incorporating in a switch case contact modules formed nearly identically together with an actuator.

DETAILED DESCRIPTION OF THE INVENTION

Figure 1:
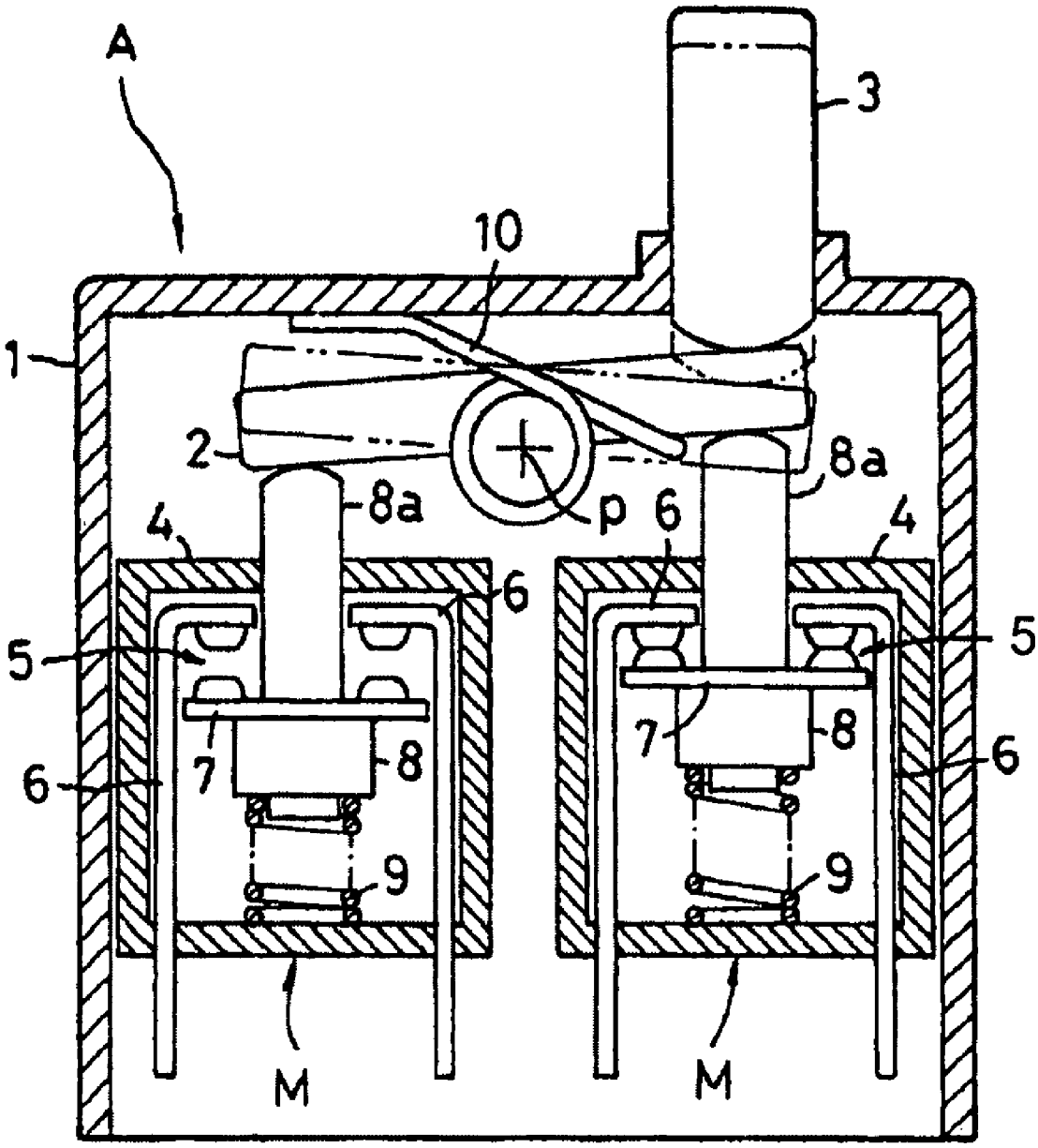
FIG. 1 is a sectional front view of a switch according to this invention for showing its basic structure.

FIG. 1 shows the basic structure of a switch A embodying this invention, incorporating two contact modules M, an actuator 2 adapted to move like a see-saw and a push button 3 for operating the actuator 2 inside a switch case 1.

The two contact modules M have the same specifications, each having a normally closed contact mechanism 5 incorporated inside a module case 4. The contact mechanism 5 is comprised of a mutually facing pair of fixed terminals 6 disposed with a certain interval in between, a mobile piece 7 made of a conductive metal plate disposed opposite to the end parts of the fixed terminals 6 from below, a plunger 8 affixed to and supported by this mobile piece 7 and a spring 9 for biasing so as to slide the plunger 8 upward. Both fixed terminals 6 protrude downward from the bottom of the module case 4 so as to be connected to an external lead line. An operating part 8*a* extends from the plunger 8 and protrudes upward from the case.

The actuator 2 is axially supported by the switch case 1 so as to be able to swing like a seesaw around a fulcrum (supporting point) p at a position above and between the two contact modules M. The operating parts 8*a* protruding from the two contact modules M are positioned opposite to both end parts of the actuator 3. The actuator 3 is biased by a spiral spring 10 provided to the fulcrum p so as to swing back in a fixed direction. The biasing force of this spiral spring 10 is stronger than the force by the upwardly biasing spring force 9 such that, according to the illustrated example, the plunger 8 is pushed in on the left-hand side of the actuator 3 under the normal condition when the push button 3 is not being operated on such that the contact mechanism 5 of the contact module M on the left-hand side is opened, and the contact mechanism 5 of the contact module M on the right-hand side is closed when the plunger 8 moves upward by the biasing force.

If the push button 2 is operated upon and is pushed down, the actuator 3 is moved in the clockwise direction in the figure against the spring 9 in the contact module M on the right-hand side such that the contact mechanism 5 of the contact module M on the left-hand side is closed and the contact mechanism 5 of the contact module M on the right-hand side is opened.

In summary, the switch A for oppositely opening and closing two circuits is thus structured by using two contact modules M having the same specification with a normally closed contact.

With reference to FIG. 1, if a plurality of junction modules M are arranged in the direction perpendicular to the plane of the figure corresponding to each of the illustrated contact modules M and if the actuator 2 is made to extend in the same perpendicular direction, a switch capable of opening and closing three or more circuits can be obtained.

Some specific examples of the invention are described next with reference to drawings.

Figure 2:
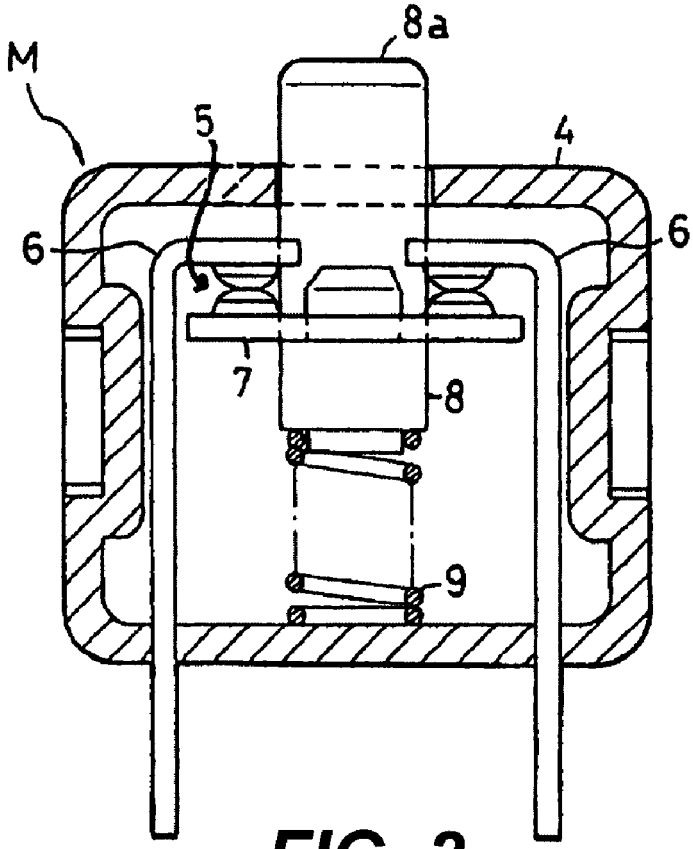
FIG. 2 is a sectional front view of a specific example of contact module.
Figure 3:
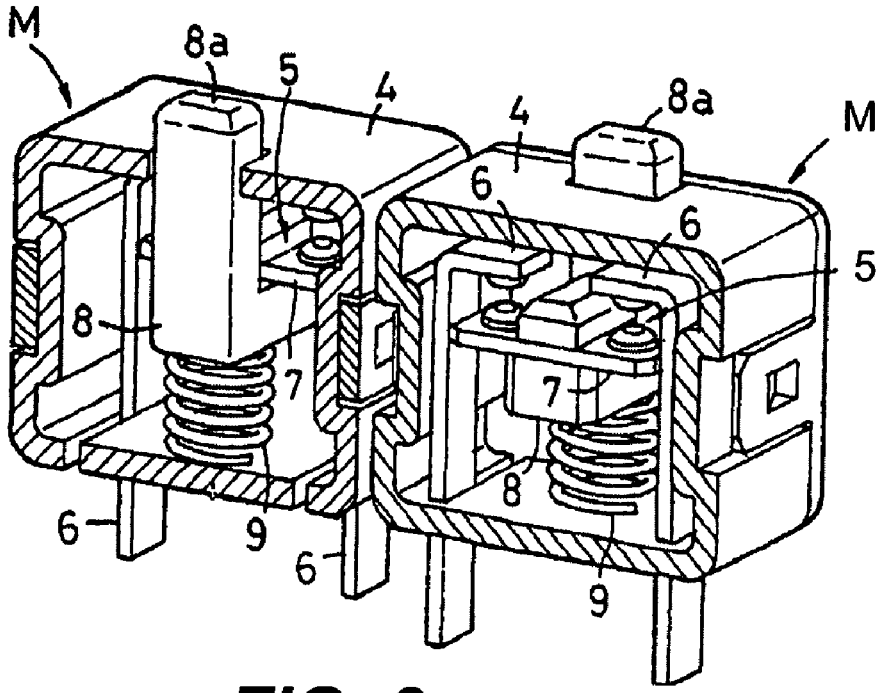
FIG. 3 is a diagonal view of two contact modules arranged in parallel with portions removed.

FIG. 2 is a front view of a specific example of the contact module M, and FIG. 3 is a diagonal view of two contact modules M arranged in parallel. The operating part 8*a* of the plunger 8 incorporated in this contact module M is at a position removed towards the back edge, and is protruding at a position removed backward from the center of the case.

Figure 5:
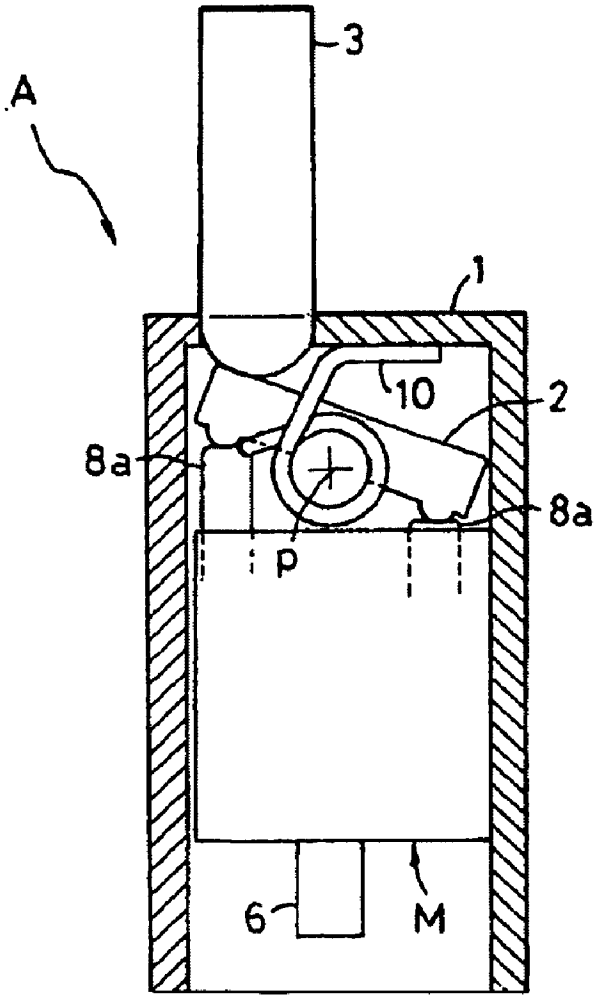
FIG. 5 is a sectional side view of the switch of FIG. 4.
Figure 4:
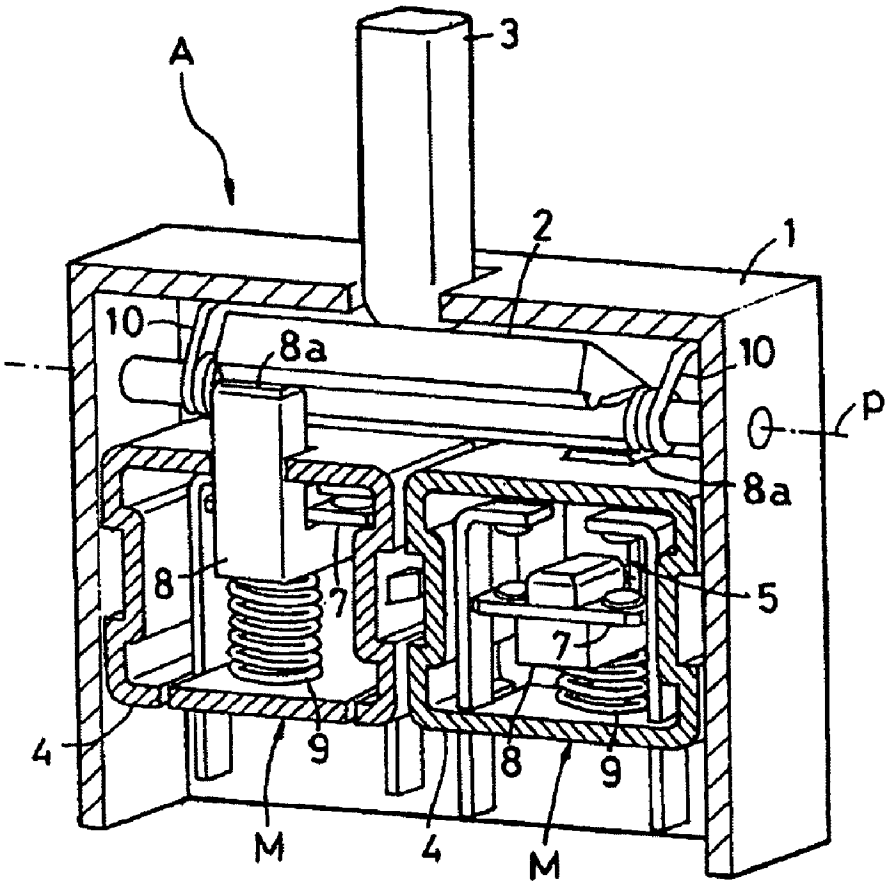
FIG. 4 is a diagonal view of an example of switch with a portion removed.

The contact module M on the right-hand side of FIG. 3 is facing frontward, while that on the left-hand side is facing backward such that the operating part 8*a* of the contact module M on the right-hand side and that of the contact module M on the left-hand side are separated in the forward-backward direction. FIGS. 4 and 5 show a switch A for two circuits incorporating two contact modules M facing thus opposite to each other and arranged next to each other.

As shown in FIGS. 4 and 5, the actuator 2 incorporated inside the switch case 1 of this switch A has a larger width, the axial direction of its fulcrum p being the direction in which the contact modules M are arranged in parallel. As shown in FIG. 4, the farther (into the paper of the figure) end of the actuator 2 is opposite to the operating part 8*a* of the contact module M on the right-hand side and the near end of the actuator 2 is opposite to the operating part 8*a* of the contact module M on the left-hand side. As the actuator 2 is caused to oscillate backward by the strong spiral spring 10, the contact mechanism 5 of the contact module M on the right-hand side is opened if the push button 3 is not being pressed, and the contact mechanism 5 of the contact module M on the left-hand side is closed.

Figure 6A:
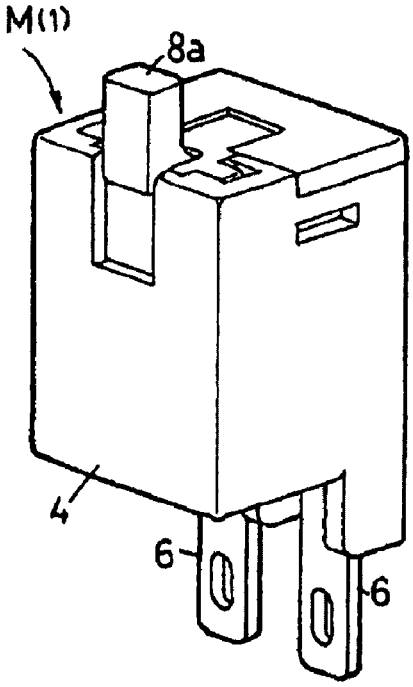
FIGS. 6A, 6B and 6C, together referred to as FIG. 6, are respectively a diagonal view of the whole of an example of contact module, a diagonal view of its plunger and its sectional side view.
Figure 6B:
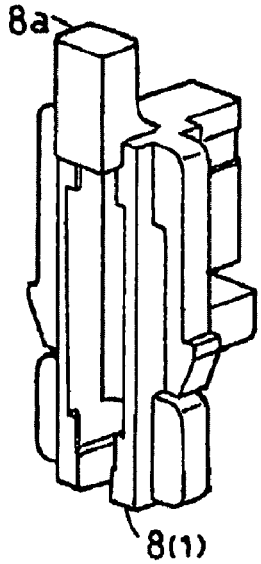
Figure 6C:
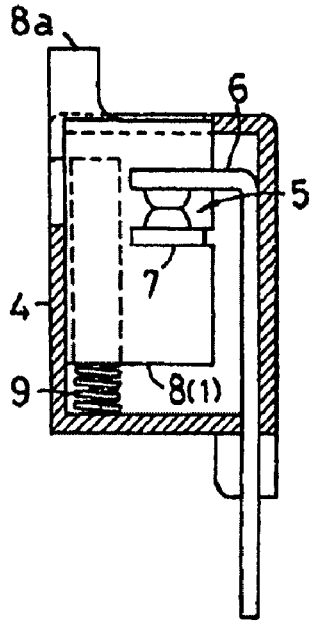
Figure 7A:
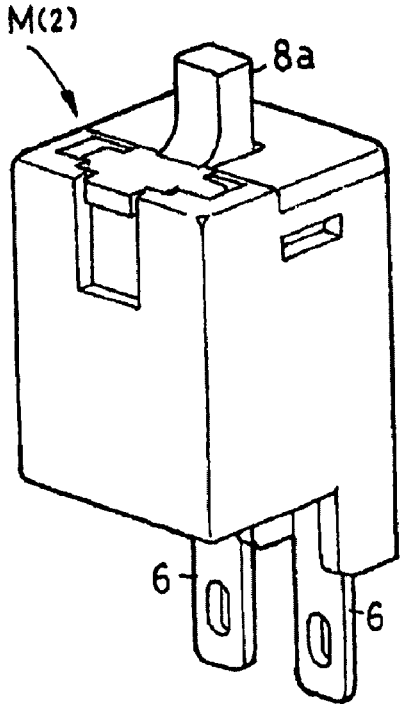
FIGS. 7A, 7B and 7C, together referred to as FIG. 7, are respectively a diagonal view of the whole of another example of contact module, a diagonal view of its plunger and its sectional side view.
Figure 7B:
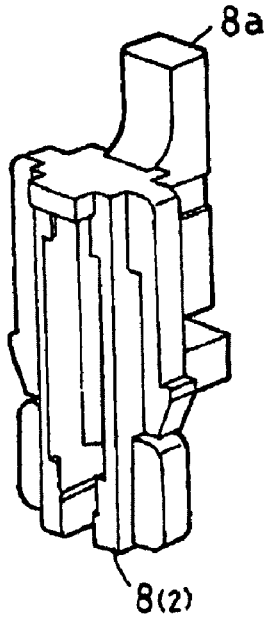
Figure 7C:
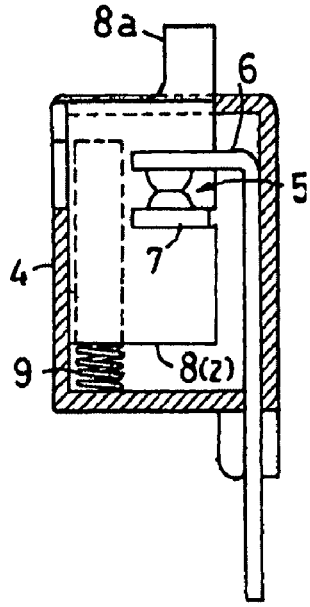

FIGS. 6A, 6B and 6C (together referred to as FIG. 6) and FIGS. 7A, 7B and 7C (together referred to as FIG. 7) show examples of contact module M(1) and M(2). FIGS. 6A and 7A are diagonal views of the whole of the contact modules M(1) and M(2), FIGS. 6B and 7B are diagonal views of their plungers 8(1) and 8(2), and FIGS. 6C and 7C are their sectional side views. The contact mechanisms 5 incorporated in these contact modules M(1) and M(2) are also formed to be generally closed, having a mobile piece 7 biased to be in contact with a pair of fixed terminals 6. All of their components other than the plunger 8 are the same between the two contact modules M(1) and M(2).

The plunger 8(1) of the contact module M(1) of FIG. 6 has its operating part 8*a* at a position displaced towards the front while the plunger 8(2) of the contact module M(2) of FIG. 7 has its operating part 8*a* at a position displaced backwards. It is therefore to be appreciated that two different kinds of contact modules M(1) and M(2) can be produced merely by using plungers of two different kinds 8(1) and 8(2) in module cases 4 of the same structure and that a switch A for opening and closing a plurality of circuits such as shown in FIGS. 8 and 9 can be easily structured by using these two kinds of contact modules M(1) and M(2).

Figure 8:
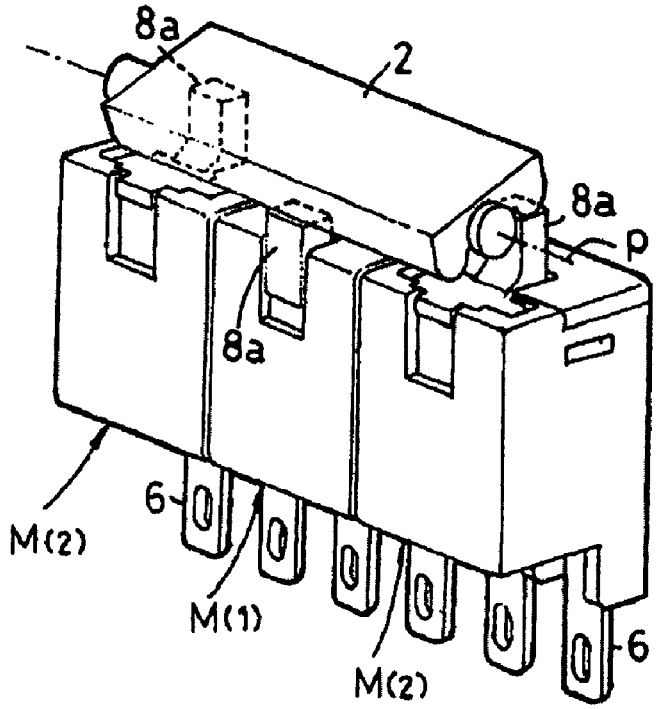
FIG. 8 is a diagonal view of an essential portion of an example of a switch with two contact modules of the kind shown in FIG. 6 and one contact module of the kind shown in FIG. 7.

FIG. 8 shows an example of switch that can thus be obtained by using one of the contact modules M(1) of the kind shown in FIG. 6 and two of the contact modules M(2) of the kind shown in FIG. 7 arranged in the axial direction of the supporting axis of the actuator 2 having an increased width in the same direction. This switch is adapted to close (or open) two circuits and open (or close) one circuit at the same time.

Figure 9:
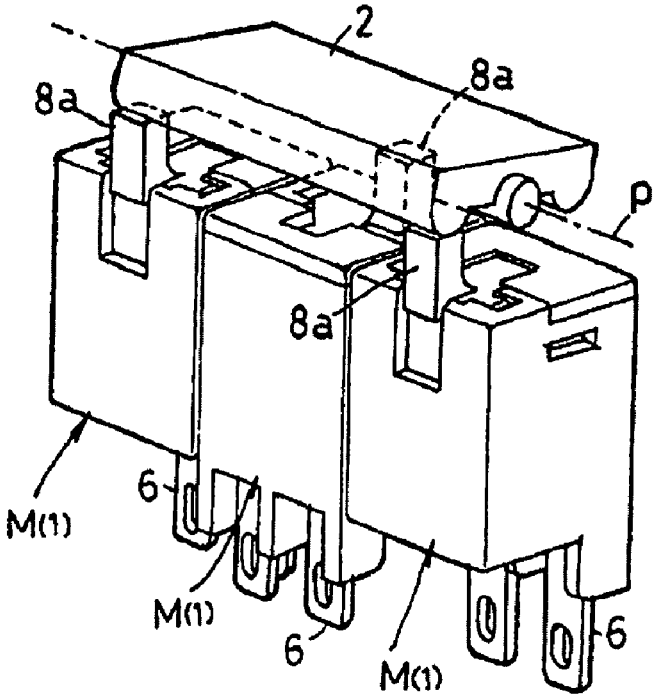
FIG. 9 is a diagonal view of an essential portion of another example of a switch with three contact modules of the kind shown in FIG. 6, one of them being turned around in a backward direction.

FIG. 9 shows another example of switch also adapted to close (or open) two circuits and open (or close) one circuit at the same time but by using three contact modules M(1) each having its operating part 8*a* displaced towards its front side with one of them (the one at the center in the illustrated example) turned around so as to face backward.

Figure 10A:
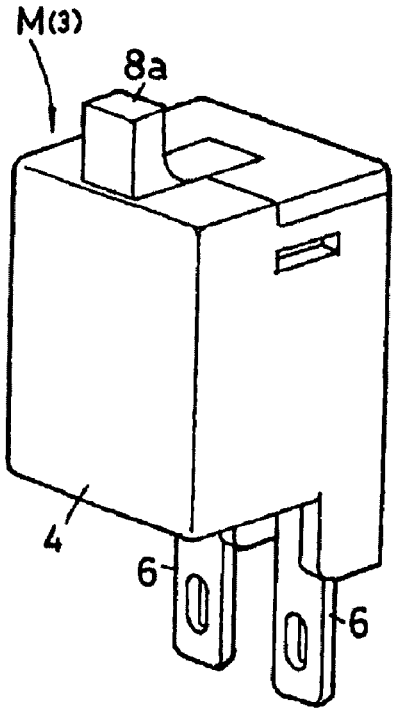
FIGS. 10A, 10B and 10C, together referred to as FIG. 10, and FIGS. 11A, 11B and 11C, together referred to as FIG. 11, are still further examples of contact modules, FIGS. 10A and 11A being diagonal whole views, FIGS. 10B and 11B being diagonal views of their plungers and FIGS. 10C and 11C being their sectional side views.
Figure 10B:
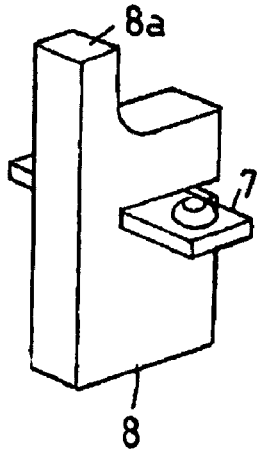
Figure 10C:
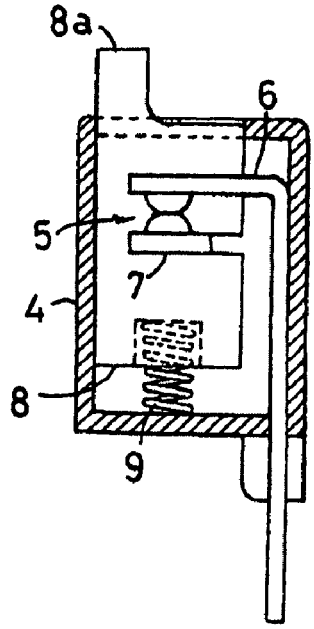
Figure 11A:
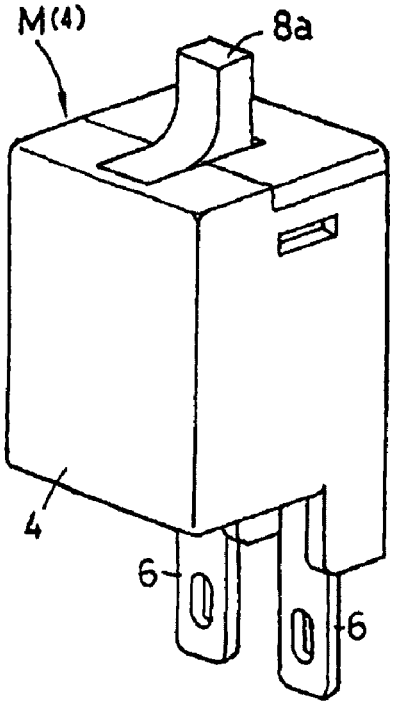
Figure 11B:
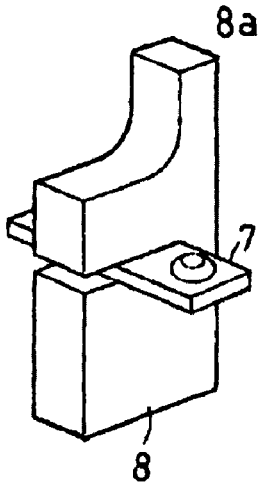
Figure 11C:
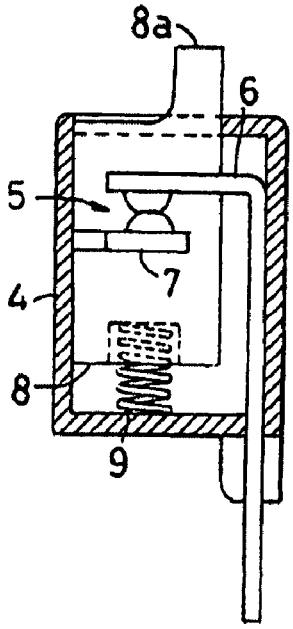

FIGS. 10A, 10B and 10C, together referred to as FIG. 10, and FIGS. 11A, 11B and 11C, together referred to as FIG. 11, show still further examples of contact modules M(3) and M(4). FIGS. 10A and 11A are diagonal whole views, FIGS. 10B and 11B are diagonal views of their plungers 8 and FIGS. 10C and 11C are their sectional side views. The contact mechanisms 5 incorporated in these contact modules M(3) and M(4) are also structured similarly to those for the contact modules M(1) and M(2) described above, forming as a normally closed mechanism with a mobile piece 7 biased so as to contact a pair of fixed terminals 6. In other words, components with the same specifications can also be used for these contact mechanisms 5.

The plungers 8 shown in FIGS. 10 and 11 have the same specifications. Each of their components is symmetrically formed in the forward-backward direction, except their operating parts 8*a* which are at shifted positions in the forward-backward direction. If the plunger 8 is contained such that its operating part 8*a* is at a position displaced in the forward direction, the contact module M(3) as shown in FIG. 10A with the operating part 8*a* displaced forward from the center of the module case 4 is obtained. If the plunger 8 is contained such that its operating part 8*a* is at a position displaced in the backward direction, the contact module M(4) as shown in FIG. 11A with the operating part 8*a* nearly at the center of the module case 4 is obtained.

Figure 12:
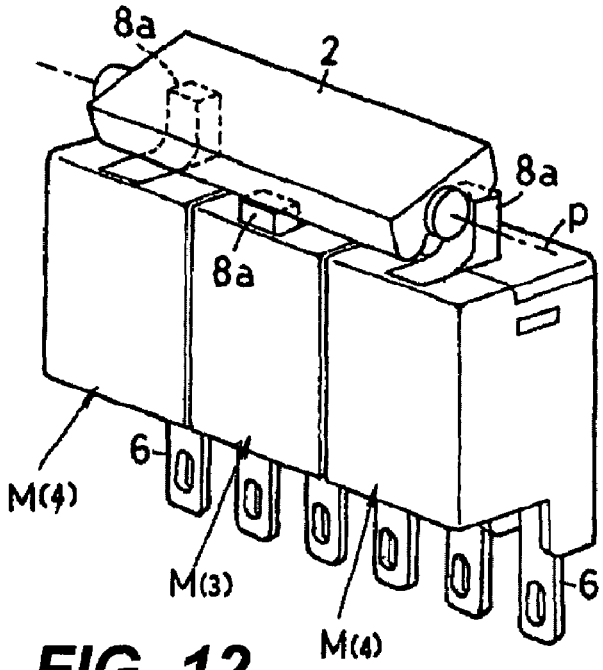
FIG. 12 is a diagonal view of another switch embodying this invention formed with contact modules of the kinds shown in FIGS. 10 and 11.

It is thus possible to obtain a switch for opening and closing a plurality of circuits by using contact modules of these two different kinds M(3) and M(4), each obtained merely by selectively determining the direction in which the position of the plunger 8 of the same specification is incorporated. FIG. 12 shows an example of a switch thus obtained, having two contact modules M(4) of the kind with the operating part 8*a* nearly at the center of the module case 4 and one contact module M(3) of the kind with the operating part 8*a* displaced forward, arranged in the direction of the axis p of the fulcrum of the actuator 2 with an extended width, thus being adapted to open (or close) two circuits with the same open-closed characteristics and to close (or open) simultaneously one circuit with the opposite open-closed characteristic.

Figure 13:
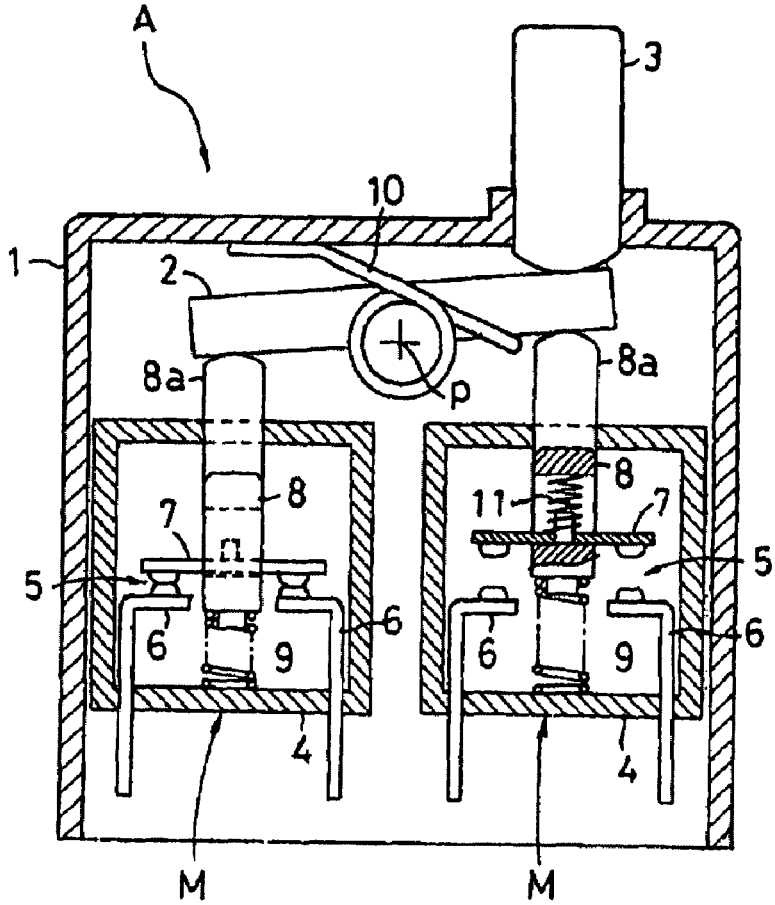
FIG. 13 is a sectional front view of another switch using contact modules according to different embodiments of this invention.

FIG. 13 shows another switch A using contact modules according to different embodiments of this invention, each incorporating a normally open contact mechanism 5 having a mobile piece 7 biased with a spring 9 in the direction of separating from the fixed terminals 6. Two contact modules M thus formed are arranged such that an actuator 2 adapted to undergo a seesaw-like motion operates on them oppositely for oppositely opening and closing two circuits. In the normally open contact mechanism 5, it is preferable to support the mobile piece 7 by the plunger 8 and to provide a back-up spring 11 for absorbing any displacement of the plunger 8 in excess of the stroke necessary for switching the contact condition by the backward displacement of the mobile piece 7.

The present invention is effectively applicable to switches of many different types such as limit switches, safety switches and door switches.

What is claimed is:

1. A switch comprising:

a plurality of contact modules each having a module case incorporating a normally closed or normally open contact mechanism and a plunger for operating said contact mechanism;

a single actuator having two end parts, said actuator being biased so as to rotate around a supporting axis between said contact modules, said actuator undergoing a rotary motion if a force is applied to one of said end parts so as to operate the plunger of an associated one of said contact modules with at least one of said end parts;

a switch case that contains said contact modules and said actuator; and a push button for applying a force on one of said end parts of said actuator from outside said switch case;

wherein said single actuator is elongated and said plurality of contact modules are arranged along said supporting axis.

2. The switch of claim 1 wherein said contact modules each incorporate a normally closed contact mechanism.

3. The switch of claim 1 wherein said plurality of contact modules have operating parts of said plungers at different positions on both sides of said supporting axis and are all arranged in a same orientation along said supporting axis.

4. The switch of claim 3 wherein said contact modules each incorporate a normally closed contact mechanism.

5. The switch of claim 1 wherein said plurality of contact modules have operating parts of said plungers at positions displaced from center of said module case on both sides of said supporting axis, specified ones of said contact modules being arranged in a reversed orientation along said supporting axis.

6. The switch of claim 5 wherein said contact modules each incorporate a normally closed contact mechanism.

* * * * *